US006056420A

United States Patent [19]

Wilson et al.

[11] Patent Number: 6,056,420

[45] Date of Patent: May 2, 2000

[54] ILLUMINATOR

[75] Inventors: David F. Wilson; Benjamin W. Dugan; Jennifer A. Johnson, all of Philadelphia, Pa.

[73] Assignee: Oxygen Enterprises, Ltd., Philadelphia, Pa.

[21] Appl. No.: 09/133,542

[22] Filed: Aug. 13, 1998

[51] Int. Cl.[7] ..... F21V 21/00

[52] U.S. Cl. ..... 362/249; 362/230; 362/249; 362/351; 362/800

[58] Field of Search ..... 362/11, 240, 248, 362/249, 369, 800, 230, 252, 351

[56] References Cited

U.S. PATENT DOCUMENTS

| | | | |
|---|---|---|---|
| 2,545,274 | 3/1951 | Golden | 240/20 |
| 2,836,707 | 5/1958 | Stitt | 240/1.1 |
| 3,143,300 | 8/1964 | Way | 240/3.1 |
| 3,950,102 | 4/1976 | Eickhorst | 365/73 |
| 4,656,567 | 4/1987 | Morris | 362/231 |
| 4,947,291 | 8/1990 | McDermott | 362/19 |
| 4,963,798 | 10/1990 | McDermott | 315/312 |
| 5,008,788 | 4/1991 | Palinkas | 362/231 |
| 5,150,016 | 9/1992 | Sawase et al. | 315/294 |
| 5,404,282 | 4/1995 | Klinke et al. | 362/249 |
| 5,410,453 | 4/1995 | Ruskouski | 362/20 |
| 5,420,768 | 5/1995 | Kennedy | 362/119 |
| 5,526,236 | 6/1996 | Burnes et al. | 362/20 |
| 5,634,711 | 6/1997 | Kennedy et al. | 362/119 |
| 5,636,303 | 6/1997 | Che et al. | 385/33 |
| 5,653,529 | 8/1997 | Spocharski | 362/235 |
| 5,655,830 | 8/1997 | Ruskouski | 362/240 |
| 5,746,500 | 5/1998 | Chein | 362/103 |
| 5,803,579 | 9/1998 | Turnbull et al. | 362/83.1 |
| 5,879,069 | 3/1999 | Chein | 362/103 |

*Primary Examiner*—Sandra O'Shea
*Assistant Examiner*—John A. Ward
*Attorney, Agent, or Firm*—Elman & Associates

[57] ABSTRACT

An illuminator for use in a darkroom or with scientific instrumentation with several light emitting diodes arranged in a regular array, a transparent structure to house the LED array, two circular end caps to prevent radiation from the end zones, an opaque decorative adhesive film surrounding the outer surface of the cylinder housing, an attachment means comprising hook and loop strips with adhesive backing and a two wire lead originating in a connector to bring power to the LED array.

22 Claims, 2 Drawing Sheets

ILLUMINATOR

FIELD OF THE INVENTION

The present invention relates to the field of illumination, and more particularly to an illuminator that is adapted to provide illumination in photographic darkroom or for scientific instruments.

The present invention provides a device comprising a multiplicity of light emitting diodes suitable for illuminating a work area. The light emitted by a device of the present invention does not interfere with the work in progress. The present invention provides an illumination source that permits the working area to be seen in a darkened laboratory, a photographic darkroom or any working area, but which does not interfere with the operation of a scientific instrument or with light sensitive optical film.

BACKGROUND OF THE INVENTION

Conventionally, filtered light sources are used to provide illumination in photographic darkrooms. Such filtered light sources require the use of lamps, typically 7 to 15 watts, positioned inside a lamp housing. Filters, so-called safelight filters, are provided to absorb the wavelengths of light to which the film is sensitive. Such darkroom lights are frequently provided with shutters and adjustments to enable the light to be directed away from work surfaces.

Such an Adjustable Filter Darkroom Light is disclosed in U.S. Pat. No. 2,545,274 ("'274") to Golden. The '274 patent describes a cylindrical enclosure to house an incandescent lamp for use in a dark room setting. The cylindrical section is held by two supporting brackets which can be attached to a wall for support. The two end brackets are rotatable to permit adjustment of the radiated light in any radial direction through a transparent slot in the cylindrical section. An electric light socket is inserted at one end of the cylinder end member. Filter members are installed on the periphery of the cylindrical housing in sections so that alternate filters with different characteristics can be slid into position, without total lamp disassembly.

U.S. Pat. No. 5,461,551 ("'551") to Clayton discloses a Portable Darkroom Safelight. The '551 patent describes a portable darkroom light which provides filtered illumination in a photographic darkroom. A recharger is provided as part of the device to provide the energy for the secondary storage batteries contained within. A light sensor is provided that deactivates the device when photographic developing is taking place so as to conserve battery energy. Accessory features built into the Clayton device include a timer to warn of a low battery condition before the lamp turns off. A pull-out stand is provided to position the lamp and point it in the direction of the work being done.

Standard darkroom lights are cumbersome and difficult to install and control. Such lights suffer from a number of disadvantages which can be problematic in a closed darkroom, such as the generation of heat. Excess heat, apart from causing discomfort, can affect film development and cause air circulation and dust problems.

It is therefore desirable to provide an illuminator for illuminating work areas such as darkrooms, that does not require filtration, provides a safe wavelength of light, does not generate heat and is safe and efficient to install and use.

SUMMARY OF THE INVENTION

In its most general form, the present invention comprises a small lightweight illuminator that emits monochromatic light. Generally, illuminators of the present intention provide visible light for persons to see and work. Illuminators of the present invention are suitable for use in locations where light-sensitive scientific instrumentation is operated or where photographic film is processed. Other embodiments of the present invention are envisioned that are adapted to be used in the home and as night-lights in areas where safety is of importance, such as in a child's room.

Certain embodiments of the present invention are illuminators adapted for use in scientific work and in dark room areas. Illuminators of the present invention adapted for use in a dark room, emit light that is without effect on film being processed in the dark room. The light emitted by illuminators of the present invention adapted for use for scientific purposes is without effect on experiments being performed.

One embodiment of the present invention is an illuminator comprising an assembly of light emitting diodes ("LEDs"). Such an assembly further comprises a housing for containing the LEDs and for directing the light emitted therefrom. Generally, the housing of an illuminator of the present invention is adapted to provide means for mounting and positioning the illuminator.

Another embodiment of an illuminator of the present invention comprises an array of LEDs secured in a transparent cylindrical housing. In this embodiment, opaque end caps prevent light escaping from the ends of the device, and an opaque film with a slit-shaped transparent area therein, is applied to the external surface of the cylindrical housing to allow light emission solely from a slit-shaped window along one side of the illuminator.

The housing of an illuminator of the present invention is provided with mounting means such as a hook-and-loop fastener, for example a Velcro fastener. Such a mounting means is adhesively attached to the outer surface of the cylindrical housing. A hook-and-loop mounting means may be applied to a limited region of the external surface of the cylindrical housing such as immediately beneath the LED array. In other embodiments, the hook-and-loop fastener may be applied to a substantial portion of the cylindrical wall so long as the aperture through which light is emitted is not obstructed.

Generally, the LEDs of embodiments of the present invention are energized from an electrical power source that is connected via conductors to the LEDs of the illuminator. Illuminators of the present invention may be powered from electrical power sources such as batteries which may be located within the illuminator or may be located externally and connected through leads entering the housing to energize the LEDs. Illuminators of the present invention may also be powered from an external electrical source such as a 110 volt supply via a suitable transformer and leads entering the housing to energize the LEDs.

An embodiment of the present invention is an illuminator comprising one row of LEDs secured in a housing, with leads from an electrical source entering the housing to energize the LEDs. In such an embodiment, a mask having an aperture therein parallel to the row of LEDs is provided through which narrow-angle-illumination from the LEDs passes. This embodiment of the present invention can be made in different forms by the use of suitable LEDs and by positioning the LEDs in the assembly so as to emit a beam of illumination over an angle from less than 4 degrees wide up to 100 degrees wide. Means for mounting the illuminator on a surface are provided.

Other embodiments of the present invention have housings of other shapes suitable to permit the installation of LEDs and the proper positioning of the device. Suitably shaped housings include cylindrical, egg-shaped, spherical or cup-shaped housings. Other suitable configurations will be obvious to those of skill in the art.

A particular object of the present invention is to provide monochromatic light of a suitable frequency. In the present invention, selection of an appropriate LED permits selection of the suitable wavelength. Thus, interfering wavelengths are excluded without resort to filtration techniques. Examples of LEDs suitable for use in embodiments of the present invention are shown in table 1.

An advantage conferred by the present invention is that a number of lamps may be assembled in an array in order to provide a desired amount of output light. In the present invention, the LEDs used generate little heat and thermal insult to nearby components is thereby minimized. The LEDs of the present invention may therefore be positioned in closely spaced arrays to provide a high intensity light output.

TABLE 1

| Manufacturer | Part No. | Emission Angle | Color | candela (approx) |
|---|---|---|---|---|
| NICHIA | NSBP510S | 30 degrees | Blue (460–485 nm) | 2 |
| NICHIA | NSBP520S | 45 degrees | Blue (460–485 nm) | 1 |
| Micro. Elect. Corp | MBB51TAH-T | 20 degrees | Blue (470 nm) | 1.5 |
| Panasonic | LNG901CF9 | 30 degrees | Blue (450 nm) | 0.5 |
| NICHIA | NSPG510S | 30 degrees | Green (510–535 nm) | 4 |
| NICHIA | NSPG520S | 45 degrees | Green (510–535) | 2 |
| AND | AND156HYP | 30 degrees | Yellow (590 nm) | 1.2 |
| Hewlett-Packard | HLMP-DL31 | 30 degrees | Amber (592 nm) | 1.7 |
| Hewlett-Packard | HLMP-DH31 | 30 degrees | Red-Orange (617 nm) | 1.6 |
| Hewlett-Packard | HLMP-DD31 | 30 degrees | Red (630 nm) | 1.4 |

Still another feature of the invention is to provide a lamp assembly that may be attached to any surface by using a variety of mounting means. Such mounting means may be hook-and-loop fasteners, clamps, clips and other ways of attaching light weight devices to surfaces as will be known to those of skill in the art. In an embodiment of the invention that comprises a hook-and-loop fastener, one portion of the hook-and-loop fastener is adhesively-adhered to the lamp assembly, and an interacting portion of the hook-and-loop fastener is positioned on a supporting wall or structure. In another embodiment of the invention that comprises a hook-and-loop fastener, one portion of the hook-and-loop fastener is adhesively-adhered to the lamp assembly, and an interacting portion of the hook-and-loop fastener is attached to a clip such as a "crocodile" clip, or clamp such as a G-clamp, which clip or clamp may be used to attach and locate the illuminator to a shelf or the like. A lamp assembly of the present invention may thereby be mounted and directed in a wide variety of directions and may be readily moved and adjusted to suit the needs of the user.

Yet another feature of the present invention is a simple power source and connectors adapted to energize the LED array. In an embodiment comprising such a power source, an LED assembly is combined with a battery of suitable voltage to make a low cost portable device. Such a device is convenient to use in a wide variety of industrial, office and home locations.

A particular advantage of the present invention is to provide illumination having a selected wavelength with low power consumption. The power consumption of an LED lamp fixture of the present invention is typically between 1 and 2 watts. Additionally, LEDs used in the present invention have a superior electrical efficiency when compared to incandescent and other types of light-emitting devices. Still further, LEDs used in the present invention have a working life at least 10 times that of other lamps thereby minimizing the need for replacement. Devices of the present invention thus provide illumination of selected wavelength, at low operating cost, and low maintenance cost.

Yet another advantage of battery-powered embodiments of the present invention is that they provide an illuminator assembly with no shock hazard because only a low voltage electrical source powers the LED assembly. This is particularly advantageous since many embodiments of the present invention are intended to be used in a darkened environment where the possibility of contact with a device is ever present. For example, darkened environments are found in a photographic darkroom, in a child's room and in experimental laboratories.

Embodiments of the present invention also advantageously emit light of specific wavelengths. Such embodiments of the inventions are suitable for use when measurements using a fluorescence or a phosphorescence microscope are being made. In a device of the present invention adapted for this type of use, the LEDs installed in the device are selected to have no emission in the phosphorescent or fluorescent frequency range. Similarly equipped devices are also suitable in an environment when making macroscopic fluorescence and phosphorescence measurements. A lamp of the present invention may also be advantageously used when making light measurements on organic tissues and the like where control of the wavelength of the ambient light is required.

The present invention is particularly convenient for use in a photographic darkroom where the directional characteristics and optical emission characteristics offer significant improvements over the lamps currently available for this purpose.

DETAILED DESCRIPTION OF THE PREFERRED EMBODIMENTS

The drawings constitute a part of this specification and include exemplary embodiments of the present invention. The present invention may also be embodied in other forms. It is to be understood that in some instances various aspects of the invention may be shown exaggerated or enlarged to facilitate an understanding of the invention.

LEDs used in the present invention, are a class of semiconductor devices that emit light when biased in a forward direction. Lamps incorporating such LEDs are typically small, stable and long lasting. Generally speaking, LEDs are energy efficient in that they deliver a relatively bright light but consume little electrical energy. For example, commercially available LEDs emit light of various wavelengths, are generally rated at less than 1 watt and use a low voltage power supply, e.g., 4.5 volts DC. Commercially available LEDs also provide an advantage in use because the low voltage used to power them is non-hazardous, is safe to the touch, and generates no fire hazard. Commercially available LEDs are generally of a small size and are often only a few millimeters across.

An LED-containing lamp emits light of a characteristic wavelength depending on the structure and chemical composition of the semiconductor from which the LED is made. Commercially available, high-intensity LEDs, include those made by Hewlett-Packard (red, orange and yellow) and those from NICHIA (green, blue-green, and blue), exemplary LEDs are listed in table 1.

Figure 1:
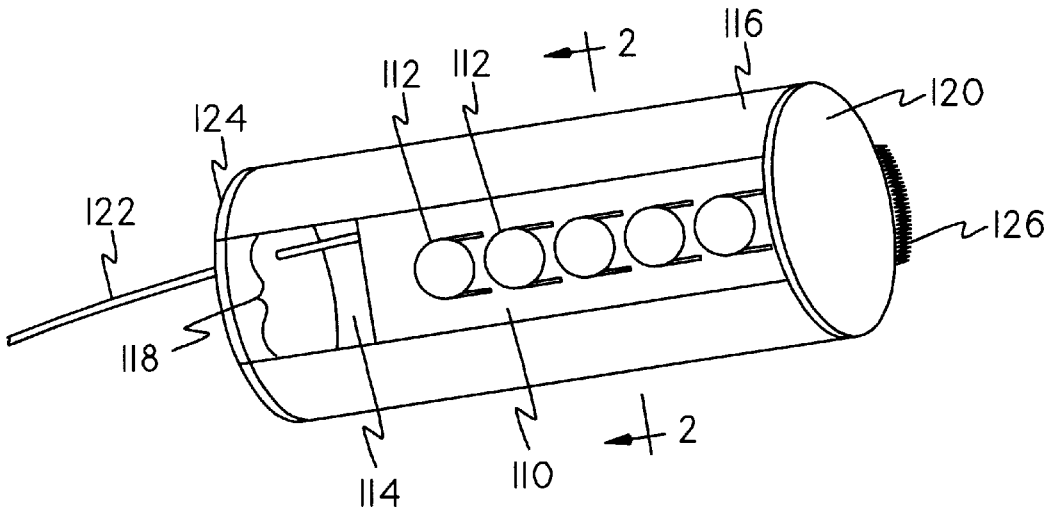
FIG. 1 is a perspective view of an embodiment of the invention.

FIG. 1 is a perspective view of an embodiment of the present invention. A printed circuit board 110 is shown with a row of LEDs 112 mounted thereon and fitted within a transparent polymer cylinder 114. An opaque film 116 covers the external surface of the polymer cylinder 114 leaving an aperture 118 through which light from the LEDs 112 emerges. One end of the polymer cylinder 114 is closed with a first opaque end cover 120 and power leads 122 exit through a second end cover 124 and connect to a source of low voltage electric power (not shown). A mounting means 126 is shown positioned on the polymer cylinder 114 diametrically opposite to the position of the aperture 118 through which light emerges when the embodiment is in use. Section line 2—2 shows the position of the section illustrated in FIG. 2.

Figure 2:
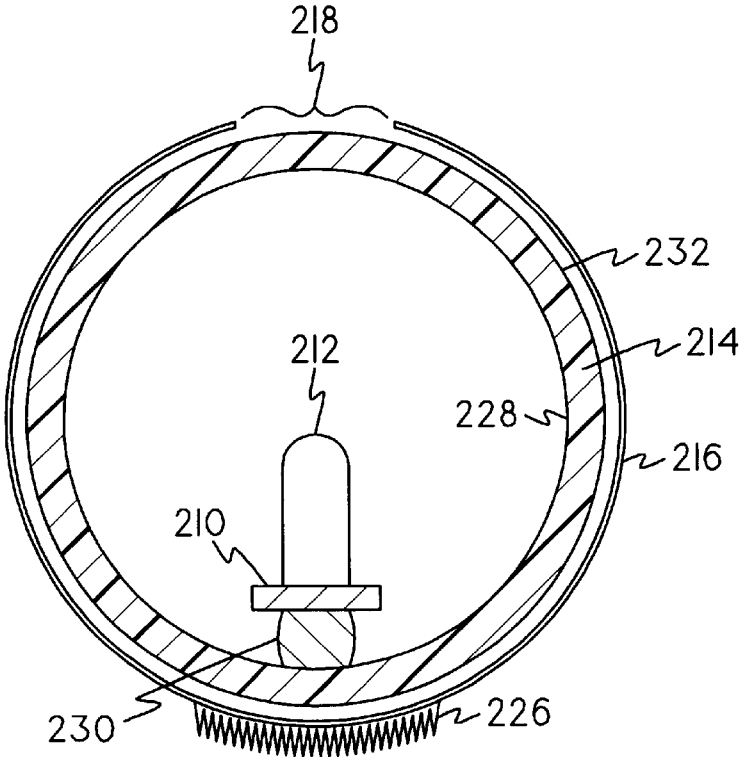
FIG. 2 is a cross-section view of FIG. 1 taken along the line 2—2.

FIG. 2 is a view of a cross-section of the assembly shown in FIG. 1 through the line 2—2. A polymer cylinder 214 surrounds the printed circuit board 210 which has the LEDs 212 mounted thereon. The printed circuit board 210 supports the LEDs 212, and is attached to the inner surface 228 of the polymer cylinder 214 by adhesive 230. Wrapped around the outer surface 232 of the polymer cylinder 214 is a thin sheet of opaque film 216. The opaque film 216 extends almost around the entire surface of the polymer cylinder 214 and forms a narrow slit 218 through which light from the LEDs 214 can radiate. The opaque film 216 extends the full length of the polymer cylinder 214. A mounting means, illustrated as a portion of a hook-and-loop strip fastener 226 is shown located on the outer surface 232 of the polymer cylinder 214.

Figure 3A:
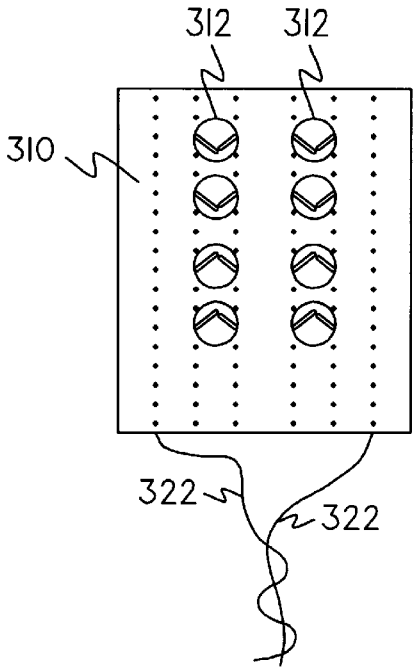
FIG. 3A is a view of the upper surface of a printed circuit board with the LEDs mounted thereon, along with limiting resistors.
Figure 3B:
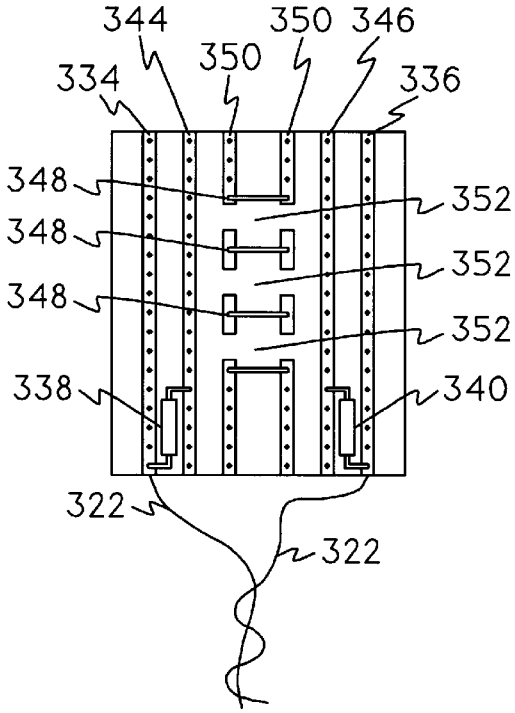
FIG. 3B is an underside view of a printed circuit board with copper runs to deliver power to the LEDs.

FIGS. 3A and 3B show a diagrammatic representation of an embodiment of the present invention. FIG. 3A shows the top view of a double row of LEDs 312 connected in series and mounted on a printed circuit board 310. A pair of connector leads 322 that connect a power source (not shown) to the LED array are shown. FIG. 3B shows a diagram of the bottom of the LED array showing the connection of the power leads 322 to a first and a second conductor strip 334, 336. The first and second conductor strips 334, 336 are connected respectively via current limiting resistors 338, 340 to a third and a fourth conductor strip 344, 346. Series connections 348 between pairs of LEDs 312 are illustrated, as are the "blank-outs" 352 in connector strips 350 which are positioned to electrically isolate each pair of LEDs. The power leads 322 are connected to an external source of power (not shown).

Figure 4:
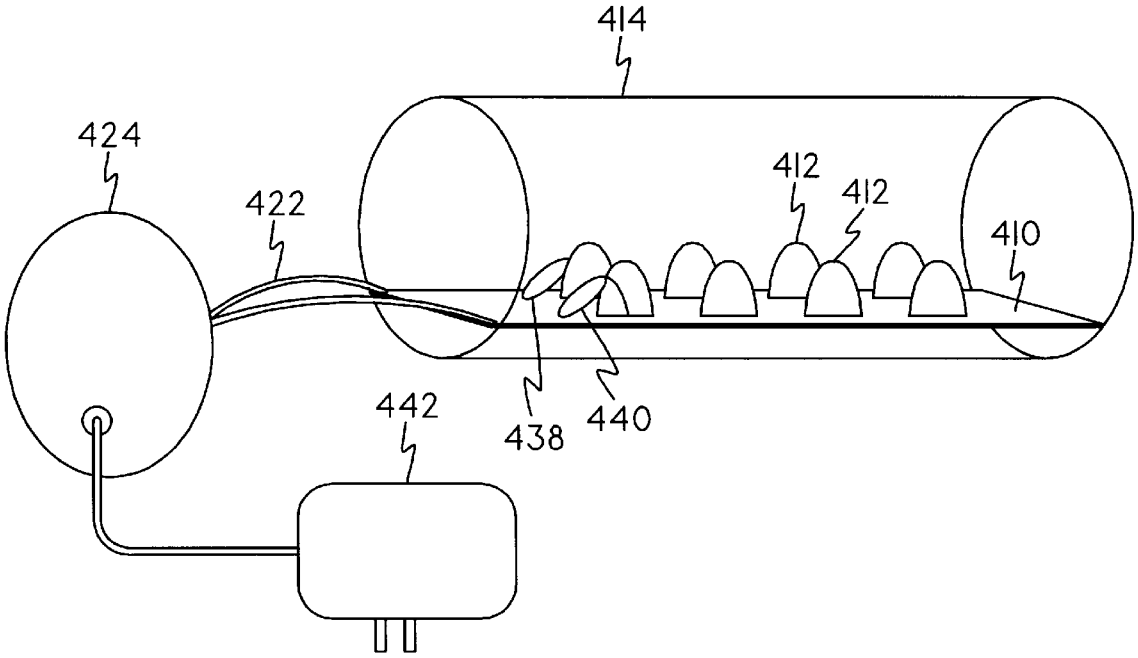
FIG. 4 is a perspective drawing of an alternate embodiment of the invention with two rows of LEDs.

FIG. 4 is a perspective drawing of an embodiment of the present invention with a two-row LED light array. FIG. 4 shows a cylindrical housing 414 with a double row of LEDs 412, mounted on a printed circuit board 410. Current limiting resistors 438 and 440 are shown connected in series with each bank of the LEDs 412. Power leads 422 are shown passing through and end cover 470 from a power source 442 which delivers a low voltage direct current to the LEDs 412.

A particular embodiment of the present invention comprises an alternate mounting means. The mounting means of this embodiment comprises a small plastic square about ⅛" thick with a ⅛" diameter peg protruding from the center thereof. A 1"×⅜" bar with a hole drilled therethrough is mounted on the ⅛" peg. The illuminator is attached to the bar by adjustable bands which pass around the illuminator and the bar. A mounting means of this kind is attachable to any surface by screws, adhesive, or by any other suitable attachment means. This mounting means permits light from an illuminator of the present invention to be directed in any direction by a combination of rotation of the lamp within the adjustable bands or rotation of the lamp on the peg.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

While the invention has been described in connection with some preferred embodiment, it is not intended to limit the scope of the invention to the particular forms set forth, but on the contrary, it is intended to cover such alternatives, modifications, and equivalents as may be included within the spirit and scope of the invention as defined by the appended claims.

What is claimed is:

1. An illuminator comprising:

a plurality of LEDs;

a housing, and at least two connectors, wherein:

said LEDs are mounted in said housing;

said connectors are connected between a power source and said LEDs;

said housing is provided with a mask that permits a narrow-angled beam of light to be emitted from said housing, and said housing is provided with mounting means for mounting said illuminator on a surface.

2. The illuminator of claim 1, wherein said mounting means is a hook-and-loop fastening material.

3. The illuminator of claim 1, wherein said mask comprises plastic film.

4. The illuminator of claim 3, wherein said plastic film has decorations thereon.

5. The illuminator of claim 1, wherein said housing comprises a transparent cylindrical tube having a cylindrical wall.

6. The illuminator of claim 5, wherein said mask comprises an opaque plastic film extending around a substantial portion of said cylindrical tube.

7. The illuminator of claim 5, wherein said means for mounting said housing comprises a hook-and-loop fastener extending around at least 90 degrees of said cylindrical wall.

8. The illuminator of claim 1, wherein said LEDs have an emission spectrum in the visible range, excluding those wavelengths of radiation to which a scientific instrument is sensitive.

9. The illuminator of claim 1, wherein said LEDs have an emission spectrum in the visible range, excluding those wavelengths of radiation to which a photographic emulsion is sensitive.

10. The illuminator of claim 1, wherein said LEDs are substantially hidden by said mask when viewed from outside the area illuminated thereby.

11. An illuminator for use in a darkroom or with scientific instrumentation comprising:

a) a plurality of LEDs arranged in an array;

b) connectors to connect a power source to said array;

c) a transparent structure to house said array;

d) means for mounting the illuminator on a surface; and e) a mask that permits a narrow-angled beam of light to be emitted from said transparent structure.

12. An illuminator of claim 11, wherein:

said plurality of LEDs comprises a dual row of LEDs mounted on a printed circuit board.

13. The illuminator of claim 11, wherein said means for mounting said illuminator comprises a hook-and-loop fastener adhesively attached to the outside of said transparent structure, said fastener being so positioned as to not block emission of said LEDs.

14. An illuminator of claim 11, additionally comprising a battery power source so assembled with an LED array to provide a portable light for industrial, office, or home use.

15. The illuminator of claim 11, wherein said LEDs emit radiation in the visible range, excluding those wavelengths of radiation to which a scientific instrument is sensitive.

16. The illuminator of claim 11, wherein said LEDs emit radiation in the visible range, excluding those wavelengths of radiation to which a photographic film is sensitive.

17. The illuminator of claim 11, wherein:

said array is positioned at a side of said transparent structure and said mask comprising:

a) an ornamental, opaque film applied to a surface of the said transparent structure to provide a narrow slit opposite said array; and b) two opaque caps applied to end sections of said transparent structure.

18. An illuminator of claim 11, wherein:

said transparent housing structure of polymer material has an elliptical cross-section.

19. An illuminator of claim 11, wherein:

said transparent housing structure of polymer material has a circular cross-section.

20. An illuminator of claim 11, wherein:

said transparent housing structure of polymer material is formed to have a cup-like shape.

21. An illuminator of claim 11, wherein:

said transparent housing structure of polymer material, is of a cylindrical cross-section.

22. The illuminator of claim 11, wherein the mounting means is a surface mounting fixture with an orthogonal post, to which said illuminator is affixed.

* * * * *